United States Patent [19]

Weyers et al.

[11] 4,132,192

[45] Jan. 2, 1979

[54] MAGNETIC BRUSH DEVELOPING APPARATUS

[75] Inventors: Jacobus R. M. G. Weyers, Maasbree; Gabriel A. M. Burm, Grubbenvorst, both of Netherlands

[73] Assignee: Océ-van der Grinten N.V., Venlo, Netherlands

[21] Appl. No.: 825,552

[22] Filed: Aug. 18, 1977

[30] Foreign Application Priority Data

Aug. 19, 1976 [NL] Netherlands ..... 7609195

[51] Int. Cl.[2] ..... G03G 15/09

[52] U.S. Cl. ..... 118/658

[58] Field of Search ..... 118/657, 658, 653

[56] References Cited

U.S. PATENT DOCUMENTS

| | | | |
|---|---|---|---|
| T959,003 | 10/1976 | Hull | 118/658 |
| 3,906,899 | 9/1975 | Harpavat | 118/657 X |
| 3,921,571 | 11/1975 | Moore et al. | 118/655 X |
| 4,014,291 | 3/1977 | Davis | 118/658 X |
| 4,063,533 | 12/1977 | White | 118/658 |

*Primary Examiner*—Werner H. Schroeder
*Assistant Examiner*—Andrew M. Falik
*Attorney, Agent, or Firm*—Albert C. Johnston

[57] ABSTRACT

High operating speeds of the powder brush of a rotating magnetic brush developing apparatus are made feasible, in order to improve the quality of developed images without causing contamination by powder escaping from the brush, by locating an air deflecting partition, for instance in the form of a plate arranged tangentially relative to the rotating sleeve of the apparatus, so that the partition will guide away an air stream entrained by the moving powder brush before it reaches the location where powder is supplied to the brush. The partition advantageously delimits a chamber formed over a sector of the powder brush, from which air carried past the partition in the powder brush and then expelled from it will escape in a controlled manner enabling recapture of the powder particles carried by such air before the air is discharged.

4 Claims, 2 Drawing Figures

MAGNETIC BRUSH DEVELOPING APPARATUS

Figure 2:
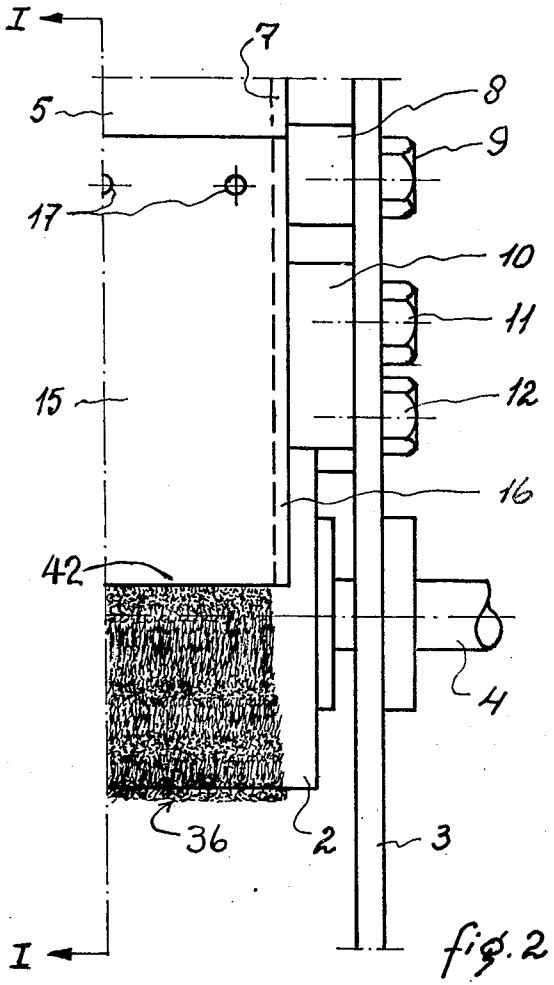

This invention relates to a developing apparatus of the magnetic brush type, comprising a rotating sleeve inside of which magnets are installed to produce a magnetic field extending outwardly through the sleeve to retain in the form of a brush magnetizable developing powder supplied in a controlled manner to the surface of the sleeve. A web or other support on which a latent electrophotographic image is present is then brought into contact with the powder brush to attract image developing powder.

Developing devices of the type mentioned are known for use in electrophotography for the development of charge or conductivity images present on an insulating and/or photoconductive layer. See, for instance U.S. Pat. application Ser. No. 715,639, filed Aug. 18, 1976, and British Pat. No. 1,412,350.

The quality of the images developed by use of the known devices is highly dependent upon the speeds of movement of the powder brush and the support. Generally speaking, the image quality is better the more these speeds differ from each other. Images of particularly good quality can be obtained when the brush rotates with a circumferential speed of 75 to 150 meters/min in a direction opposite to the movement of the support and the speed of the support is between 5 and 25 meters/-min.

Such high powder brush speeds, however, involve a great disadvantage in that much of the powder comes loose from the brush and contaminates the apparatus of which the developing device forms a part. As a result, it has been necessary to work with considerably lower circumferential speeds of the brush than would be attractive from the point of view of copy quality.

It is, therefore, an object of the present invention to provide a developing apparatus of the magnetic brush type which can be driven with the high circumferential speed desired for the improvement of image quality without causing contamination of the environs by loose powder.

It has been found that this object can be attained by the provision, at a location ahead of the location where powder is supplied onto the rotating sleeve of the developing apparatus, of an air deflector which extends over the whole working width of the sleeve and has an edge lying parallel and closely adjacent to the outer circumference of the powder brush carried on the sleeve so that much of the air present in a concentric airstream entrained by the rotating powder brush will be diverted away from the brush by the deflector before the brush reaches the powder supply location.

The provision of the air deflector stems from the observations that the rotating powder brush agitates ambient air in a manner causing the entrainment around the brush of a rapidly moving, concentric airstream and that the air becomes swirling at locations where obstacles are present in this airstream, i.e., in the known magnetic brush apparatus, at the location where powder is supplied onto the rotating sleeve. The swirling occurs more violently with increasing air speeds, i.e., as the circumferential speed of the powder brush is increased, resulting in air turbulence so violent that powder particles are blown loose from the magnetic brush and can then flow away uncontrolled to cause contamination. By means of the deflector located close to the rotating powder brush in accordance with the invention, most of the entrained airstream is led away before the brush reaches the described obstacles, so that violent air turbulence is avoided at least in the vicinity of the powder brush.

An air deflector serving the purpose of the invention may occupy any of various positions relative to the powder brush and may also have any of various shapes. The delfector, however, will ordinarily be a partition set at a suitable position relative to the rotating sleeve of the developing apparatus, and it is especially advantageous to use a partition in the form of a flat plate positioned substantially tangentially relative to the sleeve.

By virtue of the use of an air deflector according to the invention almost the entire powder contamination phenomenon in apparatus of the kind described can be prevented. The rotating powder brush, however, continues to entrain some air that can pass with it underneath the adjacent edge of the air deflecting partition, including the air present inside the hairy brush configuration formed by powder adhering to the sleeve, and this air is carried into the space between the deflector and the powder supply means. Since there is, thus, a continuous transport of air into that space, some swirling or turbulence of air may ensue in it and may cause some particles of the developing powder to escape from the brush, although to a far lesser extent than would result from the described concentric airstream.

Contamination by powder particles so escaping from the brush can be prevented in accordance with the invention simply by closing off near the ends of the sleeve the space between the air deflector and the powder supplying means, thus forming a powder capture chamber over a sector of the sleeve, and providing this chamber with air exhaust openings located at a relatively great distance away from the sleeve.

In this way the air carried by the powder brush into the space between the air deflecting partition and the powder supplying means is prevented from forming air streams directed axially along the brush, which streams would normally escape uncontrolled near the axial extremities of the sleeve and tend to carry powder away from the brush. Instead, the air carried in can escape only by traveling toward the air exhaust openings, during which travel powder entrained in the air can fall back and can re-enter the powder brush under the influence of gravity. To aid such fall-back the air exhaust openings will preferably be located as far away from the rotating sleeve as reasonably practicable. The effect can also be improved by locating the air exhaust openings at an elevation higher than the sleeve, by leading the air in a lengthened path through labyrinth chambers and/or by installing powder collectors such as filters or magnets in the path of travel of the air to the exhaust openings.

Figure 1:
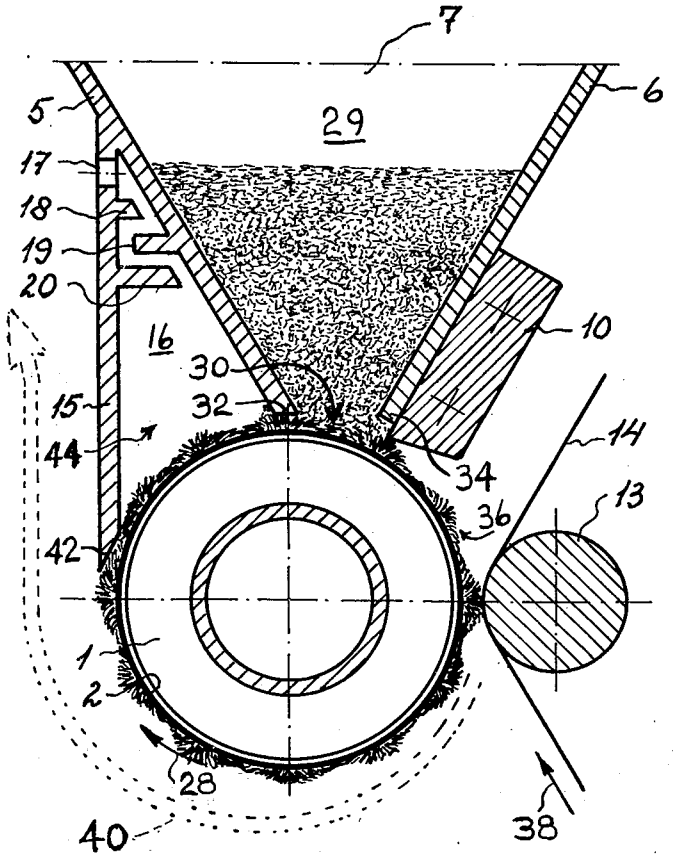

The invention will be further understood from the following description and the accompanying drawings of an illustrative embodiment. In the drawings:

FIG. 1 is a schematic cross-sectional view of a preferred embodiment of an apparatus according to the invention, and FIG. 2 is a schematic front elevational view of a part of the same apparatus.

With reference to the drawings, the illustrated magnetic brush developing apparatus includes a stationary multipolar magnet system 1, which has a form and is constructed for instance, as disclosed in the aforementioned U.S. Pat. application, Ser. No. 715,639. The magnet system 1 is surrounded by a rotatable cylindrical sleeve 2 made of a non-magnetizable and electrically conductive tube material having a relatively high specific resistance. A suitable sleeve material is for instance stainless steel of the type identified as AISI No. 303.

The magnet system 1 and sleeve 2 are held in a fixed position, as indicated in said application Ser. No. 715,639, by supports extending axially from their ends into frame plates 3, of which but one is visible in FIG. 2. One of these supports comprises a shaft 4 which is connected in fixed relation to the sleeve 2 and extends through the frame 3 to a connection with suitable drive means (not shown) by which the shaft 4 is driven so as to rotate the sleeve about the magnetic system in a clockwise direction as indicated by the arrow 28 in FIG. 1. The sleeve 2 thus is rotated, for instance, at a peripheral speed of about 100 meters/min.

A troughlike powder reservoir 29 formed by walls 5, 6 and 7 is installed above the sleeve 2. The reservoir 29 is fixed to the frame plates 3 by supports 8 and screws 9. A scraper 10 is mounted along the outside of reservoir wall 6 and fixed to the frame 3 by screws 11 and 12. When the reservoir is filled with developing powder as seen in FIG. 1, a part of the powder in a slot-like opening 30 between the lower ends 32, 34 of walls 5 and 6 is attracted and held to the surface of the sleeve 2 by the magnetic field which extends through and over the sleeve 2 from the magnet system 1. The amount of powder permitted to be picked up and removed on the sleeve 2 is limited by the lower edge of the scraper 10, which is set at a desired position so that a substantially uniform layer of the powder will be applied onto the sleeve as it is rotated past the powder supply opening. The magnetic field not only attracts this powder layer to the sleeve but also forms it into a powder brush 36 within which the powder moves and stands out in hairy configurations as the sleeve carries it about the magnet system.

A support 14 such as a sheet or a web carrying a photoconductive layer on which a latent image is to be developed is moved past a guide rod 13 in the direction indicated by arrow 38 at a speed of, for instance, 15 meters/min. The image side of the support 14 is brought into contact with the powder brush 36 so that powder is transferred from the brush and deposited imagewise onto the support in well known manner to the latent image.

The rotation of the sleeve 2 with the powder brush present on it and the attendant movements of powder within the brush itself cause a strong air stream to move concentrically near the surface of the brush 36, as indicated schematically by the trailing portion of the arrow 40 in FIG. 1. According to the present invention, this concentric air stream is diverted away from the powder brush at a location ahead of the powder supply passage 30 by an air deflecting partition 15, causing the strong air flow to pass away along the outer side of this partition as indicated by the leading portion of the arrow 40. In this manner, violent air turbulences which might beat contaminating powder particles away from the brush are prevented.

In the embodiment shown, the air deflector 15 has the form of a flat plate which is arranged in substantially tangential relation to the sleeve 2. The plate 15 presents an edge 42 lying parallel to the surface of the sleeve at the outer circumference of the powder brush on the sleeve. In this embodiment, it extends substantially vertically to the edge 42 from an upper extremity fixed to the back wall 5 of the powder reservoir 29.

Although the plate 15 is effective to guide away almost all of the air entrained due to agitation by the powder brush, there is also some air in the brush itself, and this air is carried along by the brush as it passes beneath the edge 42 of plate 15. Then, when the powder brush comes into contact with the powder supplying device, i.e., with the lower end of wall 5, air contained in the brush and any residue of air entrained over it is expelled in a way causing powder to swirl up from the brush. In order to prevent this powder from escaping, the space 44 between walls 5 and 15 is closed off by end walls 16 which extend close to the surface of the sleeve 2 at locations near its ends. In order to enhance the sealing between the lower edges of the walls 16 and the sleeve 2, strips of rubber or felt or other suitable sealing material can be used between them.

For exhausting the air expelled from the powder brush in the space 44, which now is substantially closed, a plurality of openings 17 is provided in the plate 15 at a location near its connection to wall 5, so at the greatest available distance away from sleeve 2. Hence, the air continuously supplied into space 44 from the powder brush will find its way to the exhaust openings 17, and in the course of its travel to them the powder carried along can fall back under gravity and reenter the powder brush. Thus, a purification of the air occurs before it emerges from the chamber space 44 through the openings 17.

The purification of the air can be further improved by lengthening the path that it must traverse in order to escape from the chamber. For this purpose, for instance, a labyrinth passage can be provided in the space 44, as by baffles 18, 19 and 20 which protrude in substantially parallel spaced relation from the plate 15 and wall 5 in a region of the chamber near the openings 17. The air purification may also be enhanced by providing an air filtering material, for instance a mass of glass fibers, in the labyrinth passage and/or in the openings 17. Another way of purifying the air is to make one of the baffles of magnetic material, or to provide it with magnetic parts, which will attract and retain powder carried in the air flowing toward the exhaust openings.

What is claimed is:

1. In a magnetic brush developing apparatus comprising a rotating sleeve, inside the sleeve a magnet system generating a magnetic field extending outward through the sleeve, means for supplying magnetizable developing powder in limited amount to the surface of the sleeve so that a powder brush is formed on the sleeve by the magnetic field, and means by which a support carrying a latent image to be developed can be brought into contact with the powder brush, the improvement which comprises an air deflecting partition having an edge thereof extending substantially parallel to said sleeve surface and lying closely adjacent to the outer circumference of the powder brush at a location spaced behind said powder supplying means, said partition extending over the whole working width of the sleeve and extending away from it so that an airstream entrained over the powder brush when it is rotating at high speed will be diverted away from the brush by the partition without causing powder to be driven out of the brush by air turbulence.

2. Apparatus according to claim 1, with said partition being a flat plate positioned substantially tangentially relative to the sleeve.

3. Apparatus according to claim 1, with said partition and a wall of said powder supplying means delimiting a space over a sector of said sleeve and being interconnected near the ends of the sleeve by means closing off said space to provide a powder settling chamber, said chamber being provided with a plurality of air exhaust openings in a wall portion thereof remote from said sleeve.

4. Apparatus according to claim 3, and means in said chamber between said sleeve and said air exhaust openings for enhancing separation of powder from the air flowing to said openings.

* * * * *